US006053070A

United States Patent [19]

Tieu

[11] Patent Number: 6,053,070

[45] Date of Patent: Apr. 25, 2000

[54] LATCH ASSEMBLY

[75] Inventor: Loc B. Tieu, Exton, Pa.

[73] Assignee: Southco, Inc., Concordville, Pa.

[21] Appl. No.: 09/315,999

[22] Filed: May 21, 1999

Related U.S. Application Data

[60] Provisional application No. 60/088,112, Jun. 5, 1998.

[51] Int. Cl.[7] ..... B65D 45/30

[52] U.S. Cl. ..... 74/548; 292/257

[58] Field of Search ..... 74/502.6, 512, 74/513, 548, 543, 544; 292/336.3, 257; 403/342, 343

[56] References Cited

U.S. PATENT DOCUMENTS

| | | | |
|---|---|---|---|
| D. 352,885 | 11/1994 | Holtman et al. . | |
| 2,121,989 | 6/1938 | Schnase et al. | 74/543 |
| 2,312,150 | 2/1943 | Conner | 74/543 |
| 3,386,306 | 6/1968 | Kenyon | 74/548 |
| 3,905,249 | 9/1975 | Murvall | 74/543 |
| 5,368,247 | 11/1994 | Holtman et al. . | |
| 5,533,419 | 7/1996 | Adler | 74/502.6 |
| 5,590,921 | 1/1997 | Holtman et al. | 292/257 |

OTHER PUBLICATIONS

Southco Fasteners Handbook 48 (Southco Inc., Pennsylvania, 1998) pp. J–2, J–3, J–4 and J–5.

*Primary Examiner*—David A. Bucci
*Assistant Examiner*—Chong H. Kim
*Attorney, Agent, or Firm*—Paul & Paul

[57] ABSTRACT

A latch assembly comprises a handle, a shaft and a latching member on the shaft. The handle includes a surface having a plurality of ribs that are engaged by the shaft in operation. The ribs alone and in combination with the shaft can provide a variety of features, including retaining the assembled position of the handle and shaft, limiting sideways movement of the shaft during assembly and in operation, supporting the shaft during pivotal movements of the handle in operation and as a grip for an operator.

16 Claims, 8 Drawing Sheets

LATCH ASSEMBLY

CROSS-REFERENCE TO RELATED APPLICATIONS

This is a conventional patent application based on Provisional Patent Application Ser. No. 60/088,112 filed Jun. 5, 1998.

BACKGROUND OF THE INVENTION

1. Field of the Invention

The present invention relates generally to latching devices and more particularly to latch assemblies incorporating a handle and a shaft.

2. Brief Description of the Prior Art

Various types of latch assemblies are known and which generally operate to secure one or more panel members or a panel member against a corresponding frame, as examples. One type of latch assembly is termed a swell latch assembly and comprises a pivotal handle, a shaft attached with the handle for axial movement as the handle is pivoted and a bushing secured to the shaft. In operation, the swell latch assembly is mounted in a first panel and the bushing when unlatched can be passed through a configured hole formed in a corresponding second panel or frame. On latching, pivotal movement of the handle from an open to a closed position corresponds to axial movement of the shaft. This axial movement of the shaft works to compress and deform or "swell" the bushing so as to engage an inner surface of the corresponding second panel or frame into a latched position. Examples of swell latch assemblies are disclosed in U.S. Pat. No. 5,368,347 to Eli J. Holtman, Edward A. McCormack and Jarl Mork ('347 Patent) and U.S. Pat. No. 5,590,921 to Eli J. Holtman and Edward A. McCormack ('921 Patent), each assigned to Southco, Inc., the assignee of the present invention, the entire disclosures of which are incorporated by reference herein. In order to accomplish the foregoing operation, the handle is of a sufficient size and configuration to allow it to be grasped by an operator. In the prior art, it is known to use a plurality of ribs on the underside of a handle in order to provide a better "feel" for the user when grasping the handle.

SUMMARY OF THE INVENTION

The present invention is directed to a latch assembly having a handle and a shaft secured to the handle. For this purpose, means are provided between the handle and the shaft for retaining the handle and shaft in their assembled position.

BRIEF DESCRIPTION OF THE DRAWINGS

FIG. 38 is a rear elevational view of a handle, FIG. 39 is a sectional front elevational view of the handle of FIG. 38 taken along a line similar to the line B—B of FIG. 4 and FIG. 40 is a perspective view similar to FIG. 20.

DETAILED DESCRIPTION OF THE PREFERRED EMBODIMENTS

Figure 1:
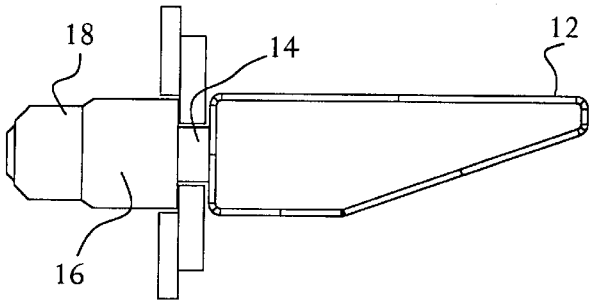
FIG. 1 is a side elevational view of an embodiment of a latch assembly comprising a swell latch assembly incorporating an embodiment of a retaining means of the present invention.
Figure 2:
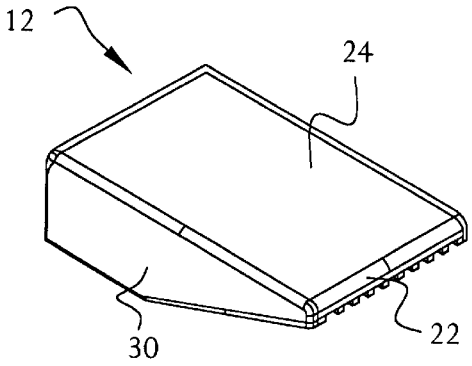
FIG. 2 is an isolated perspective view of a handle of FIG. 1.
Figure 3:
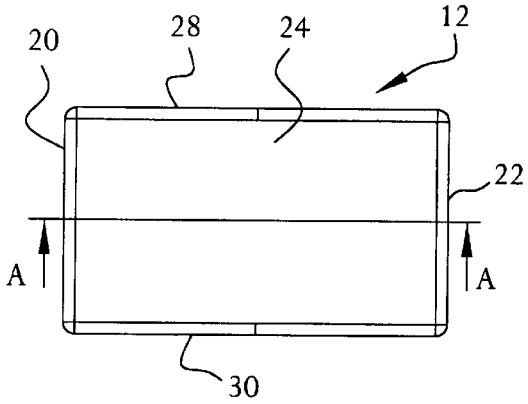
FIG. 3 is a top plan view of the handle of FIG. 2.
Figure 4:
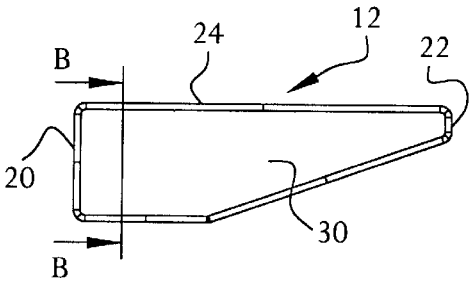
FIG. 4 is a left side elevational view of the handle of FIG. 2, the right side being a mirror image of that shown.
Figure 5:
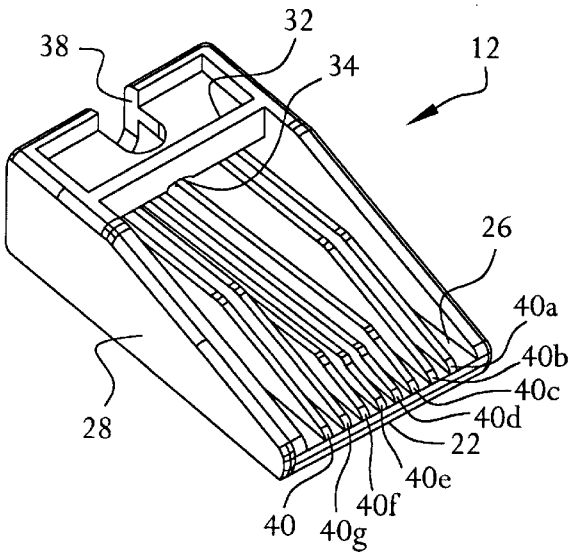
FIG. 5 is a bottom perspective view of the handle of FIG. 2.
Figure 6:
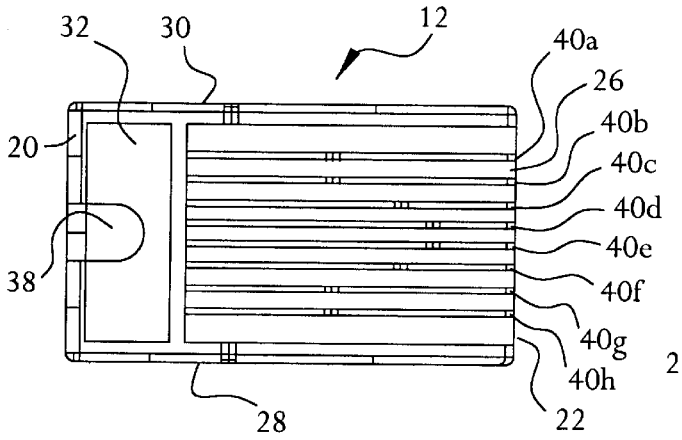
FIG. 6 is a bottom plan view of the handle of FIG. 2.
Figure 7:
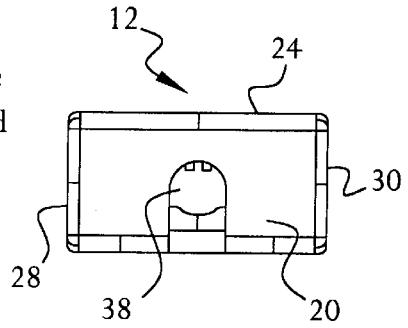
FIG. 7 is a front elevational view of the handle of FIG. 2.

Referring now to the drawings in detail, wherein like reference numerals indicate like elements throughout the several views, there is shown in the figures herewith an embodiment of a retaining means for securing together two components of a latch assembly; for example, in the illustrated embodiment, the retaining means is provided between a handle and a shaft of a latch assembly, although the retaining means in accordance with the present invention can be provided between any component or components of a latch device. For purposes of illustration, a swell latch assembly is disclosed in the present embodiment which is one type of latch to which the retaining means of the present invention can be applied. In the present embodiment, the swell latch assembly comprises, as portions thereof, a handle 12, a shaft 14 comprising a one-piece, integral member preferably comprised of thermoplastic, however other suitable materials can be provided for this same purpose, a bushing 16 comprising a resilient member generally cylindrical in shape and preferably manufactured of rubber or other suitable elastic material, and a retaining member comprising a nut 18 or similar member capable of being mounted on the shaft 14, such as a threaded connection between the nut 18 and shaft 14. For the sake of brevity, only the portions which differ from that disclosed in the '347 and '921 Patents will be described in detail herein and reference is made to the '347 and '921 Patents for a more detailed description of the various elements and operation of the swell latch assembly in accordance with the present embodiment.

The handle 12 in the present embodiment is generally rectangular in configuration defined by front and back ends 20 and 22 respectively, opposing top and bottom surfaces 24 and 26 and opposing side surfaces 28 and 30. In addition, a plurality of ribs are provided attached with the bottom surface 26 and each extending substantially along the longitudinal direction of the handle 12. The structure and operation of the ribs will be described in more detail herein. In addition, in the present embodiment, the handle 12 also includes a connecting member 32 attached with the front end 20 and opposing side surfaces 28 and 30 and at spaced separation from the bottom surface 26. In the present embodiment, the connecting member 32 includes a cavity 34 substantially radiused in configuration positioned on its upper side 36 closest to the bottom surface 26 and generally located at the center in this embodiment. In addition, in the present embodiment, a slot 38 is provided extending through the front end 20 and connecting member 32.

Figure 10:
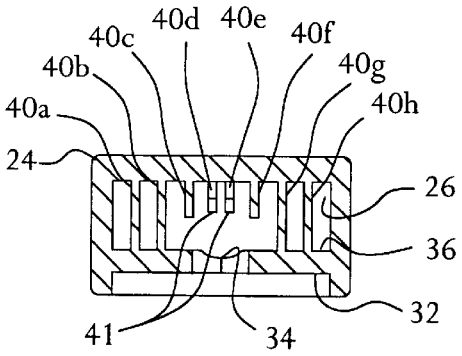
FIG. 10 is a front elevational view of the handle of FIG. 2 taken along the line B—B of FIG. 4.
Figure 11:
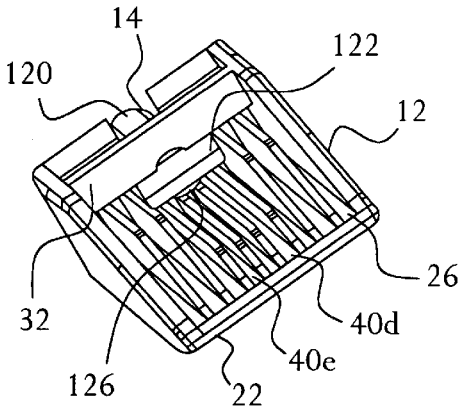
FIG. 11 is a bottom perspective view illustrating a handle and a shaft of the latch assembly of FIG. 1 during installation of the shaft and handle portions.
Figure 12:
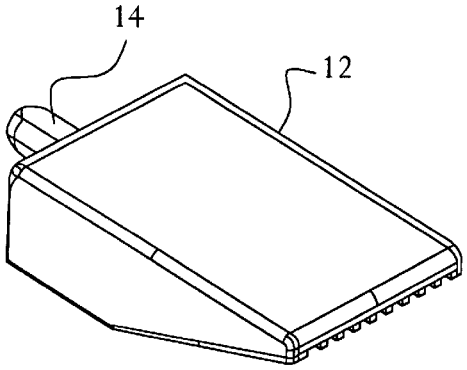
FIG. 12 is a top perspective view of the shaft and handle of FIG. 11.
Figure 13:
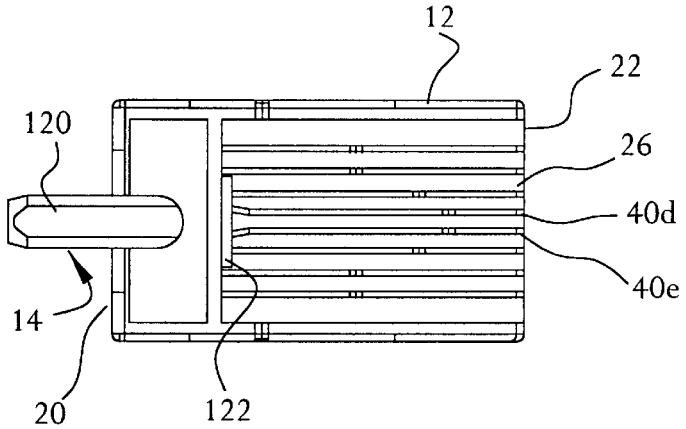
FIG. 13 is a bottom plan view of the shaft and handle of FIG. 11.
Figure 14:
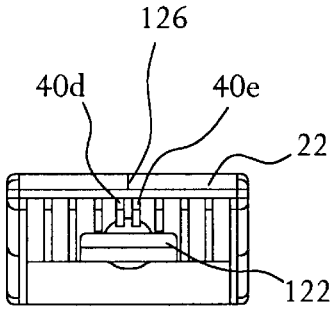
FIG. 14 is a rear elevational view of the shaft and handle of FIG. 11.
Figure 15:
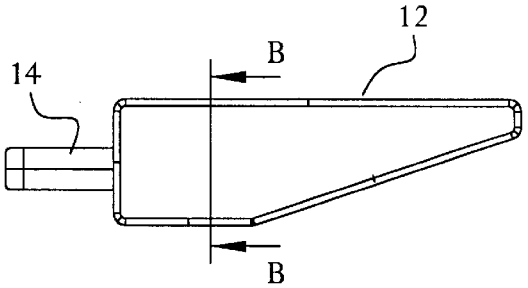
FIG. 15 is a left side elevational view of the shaft and handle of FIG. 11, the right side being a mirror image of that shown.
Figure 16:
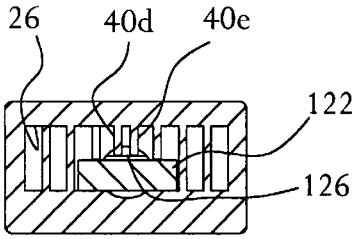
FIG. 16 is a rear elevational view of the shaft and handle of FIG. 11 taken along the line B—B of FIG. 15.
Figure 17:
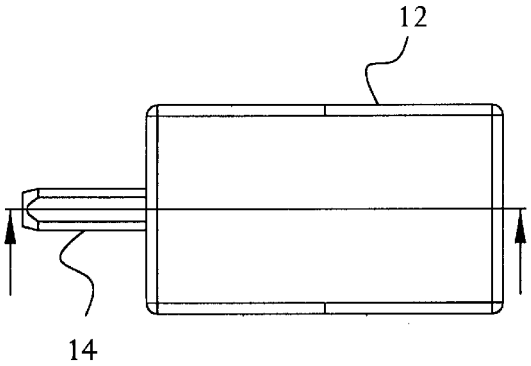
FIG. 17 is a top plan view of the shaft and handle of FIG. 11.
Figure 18:
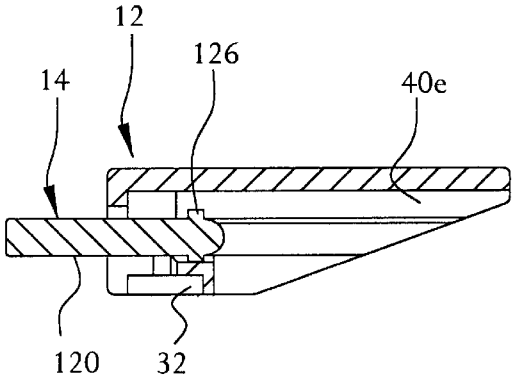
FIG. 18 is a right side elevational view of the shaft and handle of FIG. 11 taken along the line A—A of FIG. 17.
Figure 19:
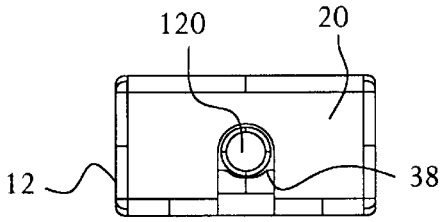
FIG. 19 is a front elevational view of the shaft and handle of FIG. 11.
Figure 20:
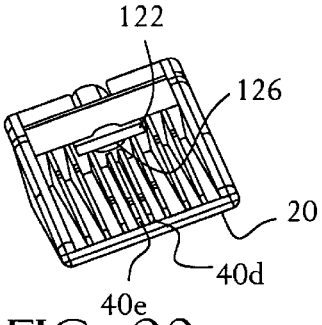
FIGS. 20–28 are views similar to FIGS. 11–19 and showing the shaft and handle portions assembled and positioned corresponding to an unlatched position of the latch assembly of FIG. 1.
Figure 21:
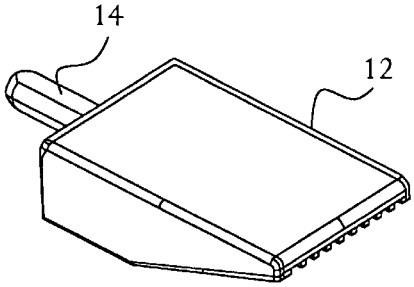
Figure 22:
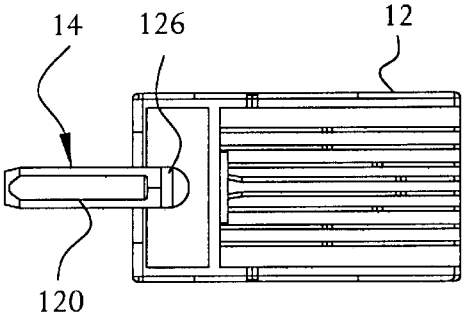

As illustrated in the figures, eight ribs 40*a*–40*h* are provided attached with the bottom surface 26 of the handle 12, although as should be understood any number of ribs can be provided for the purpose described below. Ribs 40*d* and 40*e* shall be thicknessed such that they temporarily are able to deflect upon being acted on. In this embodiment, each of the ribs 40*a*–40*h* extend substantially along the entire longitudinal axis of the handle 12. Generally, each of the ribs 40*a*–40*h* define an acute angled first portion beginning at the back end 22 and extending generally to the middle of the handle 12 and a substantially planar second portion extending from the acute angled first portion to the first end 20 of the handle 12. In addition, in the present embodiment, the planar second portions of the ribs 40*a*, 40*b*, 40*g* and 40*h* define a lower surface which engages the upper surface of the connecting member 32. In addition, in this embodiment, the ribs 40*c*, 40*d*, 40*e* and 40*f* define a lower surface that is spaced from the upper surface of the connecting member 32. Further, in the present embodiment, each of the ribs 40*c* and 40*f* also include a third portion 41 attached with the substantially planar second portion and positioned adjacent the front end 20 of the handle 12, and which is substantially verticalled in the direction of the bottom surface 26, as best seen in FIG. 10. The remaining portions and composition of the handle 12 as well as the structure and composition of the shaft 14, bushing 16 and nut 18 are identical to that disclosed in the '347 and '921 Patents.

The assembly of the handle 12 and shaft 14 will now be described. As discussed earlier, retaining means are provided between the handle 12 and shaft 14, which in the present embodiment is accomplished between the ribs on the handle 12 and second portion 122 of the T-shaft shaft 14. For example, as illustrated in FIGS. 11–19, in the present embodiment, the shaft 14 is installed from the back end 22 of the handle 12, with the elongated first portion 120 of the shaft 14 being inserted through the slot 38 in the front end 20 and connecting member 32 of the handle 12. As the shaft 14 is moved into its mounted position, in this embodiment the first shoulder or boss 126 adjacent to the second portion 122 of the shaft 14 engages and rides against the substantially planar second portions of the ribs 40*c* and 40*d*. In addition, in the present embodiment, the ribs 40*d* and 40*e* are flexed and moved apart from one another by the first shoulder 126, which is moved in the direction of the bottom surface 26 of the handle 12 due to the configuration of the shaft 14, the position of the slot 38 in the handle 12, the size of the space between the upper surface of the connecting member 32 and lower surface of the ribs 40*d* and 40*e*, together with the configuration of the ribs 40*d* and 40*e* themselves. As the shaft 14 is moved into its mounted position within the handle 12, such as shown in FIGS. 20–37, the first shoulder 126 is moved past the concave shape third portion of the ribs 40*d* and 40*e*, allowing the ribs 40*d* and 40*e* to move back toward their original position, with the second shoulder 126 then being positioned within the slot 38. In this manner, the ribs 40*d* and 40*e* are adapted to retain the shaft 14 within the handle 12 by contacting the first shoulder 126 whenever the shaft 14 is moved in the direction of the back end 22 of the handle 12. This feature is particularly advantageous from the stand point that it allows the shaft 14 and handle 12 to be shipped as a unit and also it restricts disassembly of these components in operation. Also, during assembly, the two ribs 40*b* and 40*g* define walls which restrict sideways movement of the shaft 14 due to their close proximity with the ends of the second portion 122 of the shaft 14.

Figure 23:
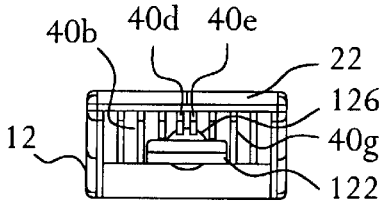
Figure 24:
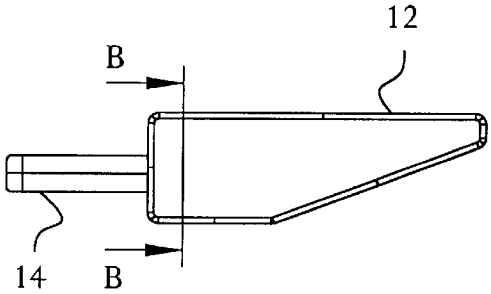
Figure 25:
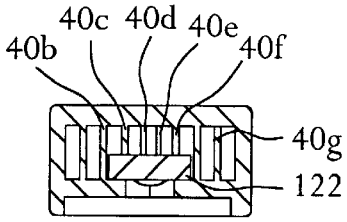
Figure 26:
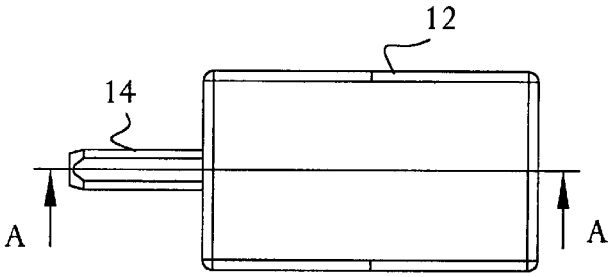
Figure 27:
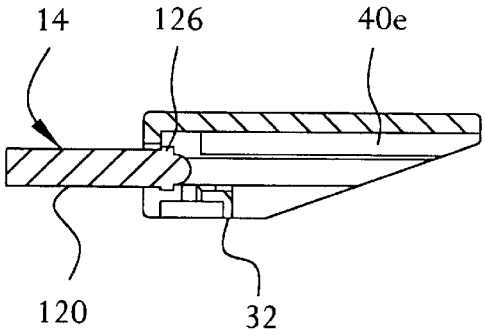
Figure 28:
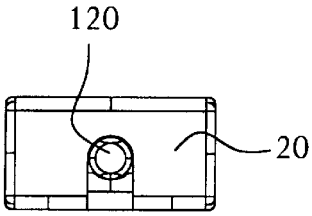
Figure 29:
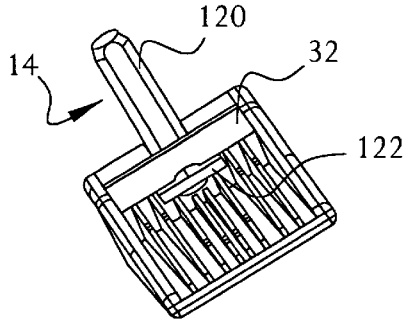
FIGS. 29–37 are similar to the views of drawing FIGS. 20–28 illustrating the shaft and handle portions assembled and positioned corresponding to a latched position of the latch assembly of FIG. 1.
Figure 30:
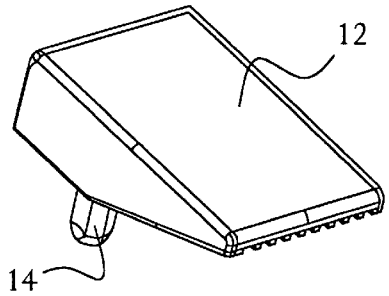
Figure 31:
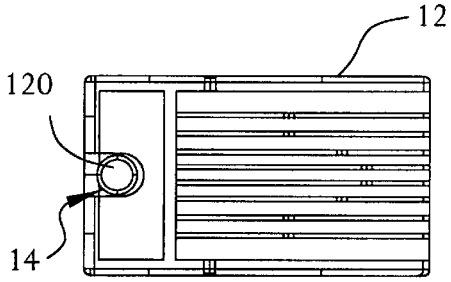
Figure 32:
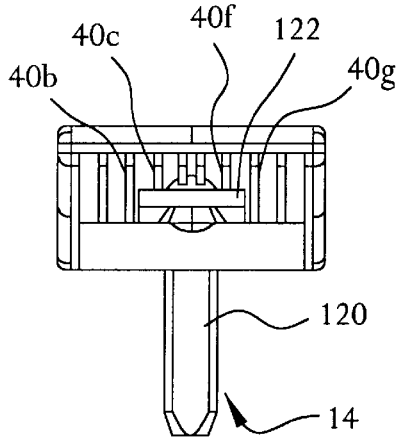
Figure 33:
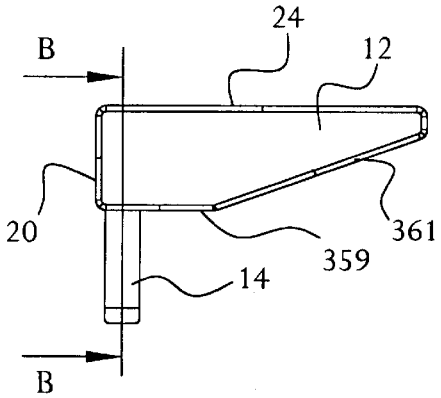
Figure 34:
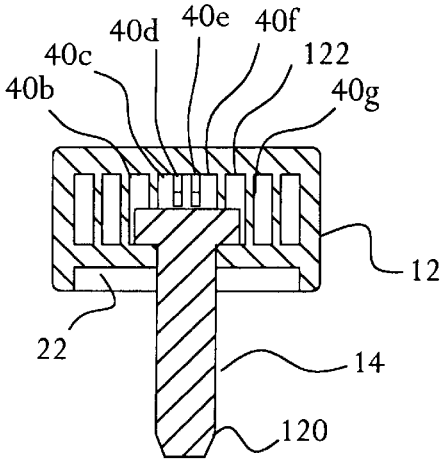
Figure 35:
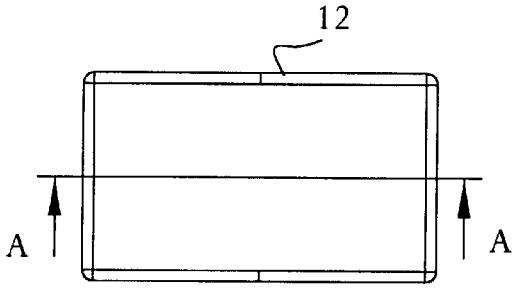
Figure 36:
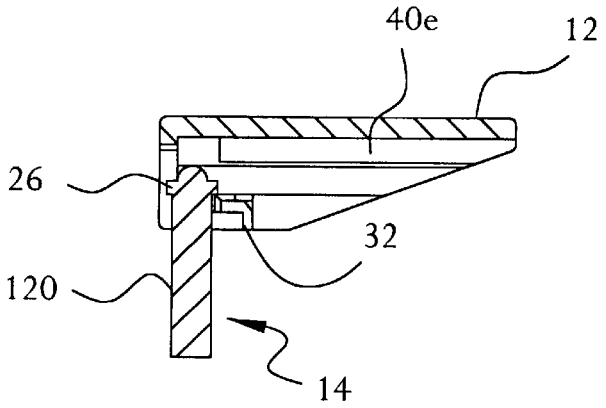
Figure 37:
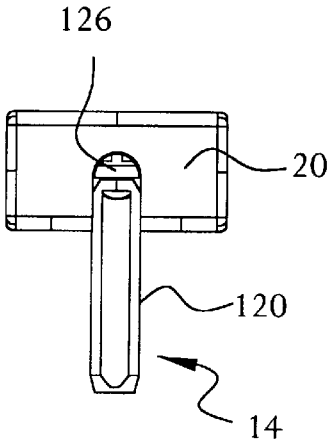

Moreover, when the handle 12 and shaft 14 are in a mounted position, such as in a panel, and assembled to the bushing 16 and nut 18, such as shown in FIG. 1, the ribs 40*b* and 40*g* again operate to limit sideways movement of the shaft 14 during operation due to its proximity to the ends of the second portion 122 of the shaft 14, which is illustrated in FIGS. 23 and 32, but without showing the panels, bushing 16 and the nut 18 in FIG. 1. In addition, as illustrated in FIGS. 25 and 34, the ribs 40*c* and 40*f* operate as support for the shaft 14 in operation due to its position close in proximity to the second portion 122. Similarly, for the same reason, when the swell latch assembly is in its latched position, such as the position shown in FIGS. 29–37 but without showing the panels, bushings 16 and nut 18 of FIG. 1, the ribs 40*c* and 40*f* operate to keep the shaft from going backwards up into the handle.

Figure 8:
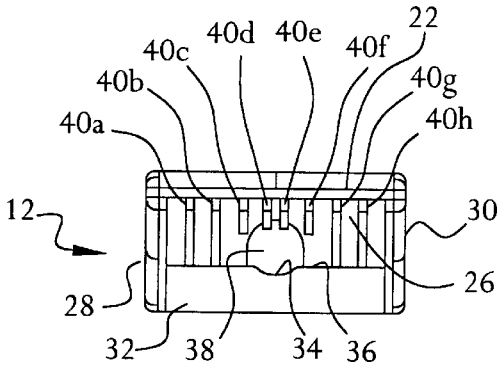
FIG. 8 is a rear elevational view of the handle of FIG. 2.
Figure 9:
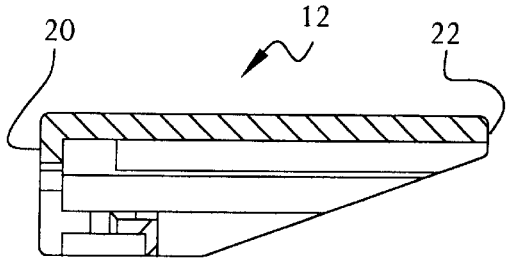
FIG. 9 is a left side elevational view of the handle of FIG. 2 taken along the line A—A of FIG. 3.
Figure 38:
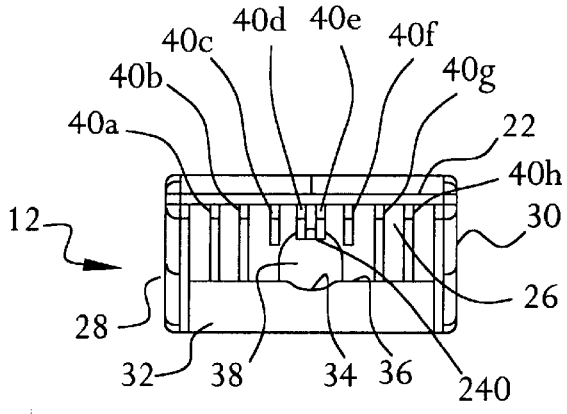
FIGS. 38–40 illustrate the swell latch assembly of FIG. 1 incorporating another embodiment of a retaining means of the present invention.
Figure 39:
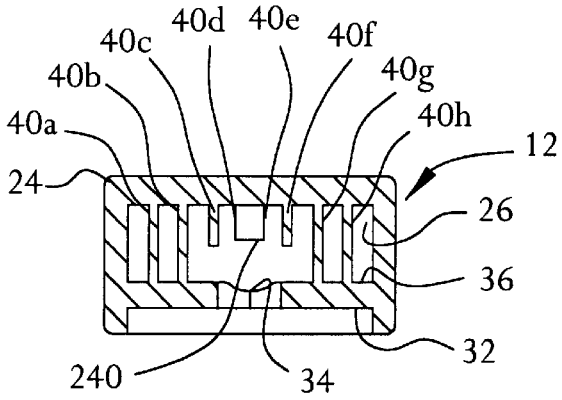
Figure 40:
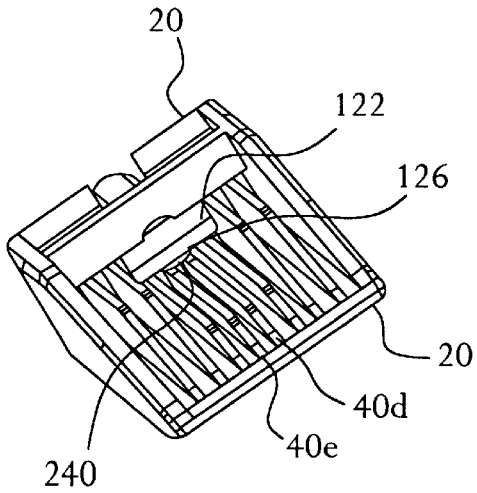

Another embodiment of a retaining means in accordance with the present invention is shown in FIGS. 38–40. For the sake of brevity, the retaining means of the present embodiment will be described with reference to the first embodiment of the retaining means described above, for example, FIG. 38 corresponds to FIG. 8, FIG. 39 corresponds to FIG. 10 and FIG. 40 corresponds to FIG. 20. The only difference in the retaining means of the present embodiment is the addition of a rib 240. As shown in FIGS. 38–40, rib 240 is attached with the bottom surface 26 on the handle 12 and preferably is also attached with the terminating end of ribs 40*d* and 40*e* that is proximate the front end 20 of handle 12. In this embodiment, the rib 240 interacts with the shaft 14 during assembly and in operation. The shaft 14 is assembled with the handle 12 by moving the boss 126 past the rib 240. In one embodiment, the rib 240 is similar to ribs 40*d* and 40*e* in that rib 240 is of a thickness to be temporarily deflected upon being acted on by the boss 126. During assembly, the boss 126 will come into engagement with the rib 240 and continued movement will move boss 126 over and past rib 240, with the shaft 14 then being in its assembled position with handle 12. One advantage of the rib 240 is that the interaction between the boss 126 and rib 240 during assembly provides a positive feel to let the operator know when the shaft 14 has been moved into its mounted position. Another advantage is that the rib 240 acts as additional retention to hold the shaft 14 in is assembled position; in particular, after the shaft 14 has been assembled with the handle 12, the boss 126 will come into engagement with the rib 240 upon movement of the shaft 14 toward the back end 22 of handle 12.

It will be recognized by those skilled in the art that changes may be made by the above-described embodiments of the invention without departing from the broad inventive concepts thereof. For example, as discussed earlier, the retaining means feature of the present invention can be provided in other types of latch assemblies as well, such as pawl latches as an example. In addition, while the handle and shaft portions in the disclosed embodiment are comprised of thermoplastic, it should be understood that these portions can be comprised of any other suitable material as well. In addition, the various features comprising the retaining means of the present embodiment can be included in other embodiments alone or any other combination. For example, one aspect of the retaining means in the disclosed embodiment is between the shaft 14 and ribs 40*d* and 40*e*, another aspect of the retaining means of the present embodiment is between the ribs 40*b* and 40*g* and the shaft 14 and a third aspect of the retaining means of the present embodiment is between the shaft 14 and the ribs 40*c* and 40*f*. As should be understood, while in the disclosed embodiment each of these three aspects are included in the same device, this is not required. In addition, in the disclosed embodiment, while the ribs 40*a*–40*h* also operate as a grip for an operator during operation, this is riot required and the ribs 40*a*–40*h* can be provided solely for the purpose of the retaining means feature described above, for example, the ribs can extend less than the entire longitudinal axis of the handle 12, such as only being proximate the connecting portion 32. In addition, while in the disclosed embodiment the eight ribs 40*a*–40*h* are disclosed, it should be understood that any number of ribs can be provided; for example, only the two ribs 40*d* and 40*e*, only the four ribs 40*c*–40*f*, only the six ribs 40*b*–40*g* or any other number or combination. Also, the surface 359 of handle 12 illustrated in FIG. 33 can be provided angled relative to a horizontal axis rather than planar as shown; for example, the surface 359 being angled inwardly toward the top surface 24 of handle 12 beginning at the front end 20 and continuing to the angle surface 361. In one embodiment, the surface 359 includes a 5 degree angle, although other angles are also possible. The angle of surface 359 helps to retain the handle 12 in its closed position against the bias of bushing 16. It is understood, therefore, that this invention is not limited to the particular embodiments disclosed, but it is intended to cover all modifications which are within the scope and spirit of the present invention as defined by the appended claims.

I claim:

1. A latch assembly comprising a handle generally elongated along a longitudinal axis, a generally elongated shaft and retaining means for connecting said shaft and said handle, said retaining means comprising a surface of said handle having at least two generally resilient ribs at spaced separation and at least one mounting boss on said shaft, and a connecting rib attaching said at least two generally resilient ribs, wherein said spaced separation between said at least two generally resilient ribs in a mounted position of said shaft is sized smaller than a diameter of at least a portion of said mounting boss, and on assembly of said shaft and said handle, said at least a portion of said mounting boss is positioned between said at least two generally resilient ribs by flexing said at least two generally resilient ribs apart from one another to increase the size of said spaced separation, wherein each of said at least two generally resilient ribs includes first and second terminating ends and said connecting rib is positioned proximate said first terminating ends of said at least two generally resilient ribs, wherein said mounting boss of said shaft engages and is moved past said connecting rib on assembly, and when the shaft and handle are assembled, said mounting boss engages and does not move past said connecting rib to retain the assembled positions of the handle and shaft.

2. A latch assembly of claim 1, wherein said handle further comprises a connecting wall at spaced separation from at least a portion of said at least two generally resilient ribs, wherein said shaft engages said connecting wall when said at least a portion of said mounting boss is positioned between said at least two generally resilient ribs on assembly.

3. A latch assembly of claim 2, wherein said shaft is generally t-shaped in configuration comprising a first portion substantially perpendicular to a second portion, wherein said latch assembly further comprises third and fourth ribs at spaced separation and with said third rib closer to a first of said at least two generally resilient ribs and said fourth rib closer to a second of said at least two generally resilient ribs, wherein opposite ends of said first portion of said shaft in said mounted position are positioned proximate said third and fourth ribs, respectively.

4. A latch assembly of claim 3 further comprising fifth and sixth ribs at spaced separation, with said fifth rib positioned between said first of said at least two generally resilient ribs and said third rib and with said sixth rib positioned between said second of said at least two generally resilient ribs and said fourth rib, wherein said first portion of said shaft engages said fifth and sixth ribs during operation.

5. A latch assembly of claim 4, wherein each of said ribs extend outwardly a predetermined amount from said surface of said handle, wherein said third and fourth ribs at least adjacent said connecting member extend further from said surface of said handle than said fifth rib, sixth rib and said at least two generally resilient ribs, and said fifth and sixth ribs at least adjacent said connecting member extend further from said surface of said handle than said at least two generally resilient ribs.

6. A latch assembly of claim 5, wherein said handle includes a top wall, opposing side walls and a front wall, wherein said surface of said handle comprises a bottom surface of said top wall, said connecting wall is attached to said opposing side walls and an aperture extends through said handle located extending through a portion of said front wall and through a portion of said connecting wall into which said second portion of said shaft is received in operation.

7. A latch assembly of claim 6, wherein each of said ribs extend along said longitudinal axis of said handle.

8. A latch assembly of claim 7, wherein each of said ribs comprises a generally planer end surface and an adjacent angled surface opposite said bottom surface of said top wall of said handle.

9. A latch assembly comprising a handle and a shaft, said handle being generally elongate along a longitudinal axis and including a top wall and a plurality of generally elongate ribs on a bottom surface of said top wall, said shaft being generally elongate having first and second portions and with said first portion engaging at least one of said plurality of ribs and said second portion having thereon a latching member; and wherein said handle includes at least two generally flexible ribs at spaced separation on said bottom surface for engaging at least one mounting boss on said first portion of said shaft, wherein said spaced separation between said at least two generally flexible ribs in a mounted position of said shaft is sized smaller than a diameter of at least a portion of said mounting boss to retain connection of said shaft and said handle, and on assembly of said shaft and said handle, said at least a portion of said mounting boss is moved between said at least two generally flexible ribs by flexing said at least two generally flexible ribs apart from one another to increase the size of said spaced separation and allow said shaft to be moved into said mounted position;

said latch assembly further comprising a connecting rib attaching said at least two generally flexible ribs, wherein each of said at least two generally flexible ribs includes first and second terminating ends and said connecting rib is attached proximate said first terminating ends of said at least two generally resilient ribs, wherein said mounting boss of said shaft engages and is moved past said connecting rib on assembly, and when the shaft and handle are assembled, said mounting boss engages and does not move past said connecting rib to retain the assembled positions of the handle and shaft.

10. A latch assembly of claim 9, wherein said handle further comprises a connecting wall at spaced separation from said at least two generally flexible ribs, wherein said first portion of said shaft engages said connecting wall when said at least a portion of said mounting boss is positioned between said at least two generally flexible ribs on assembly.

11. A latch assembly of claim 10, wherein said shaft is generally t-shaped in configuration with said first portion substantially perpendicular to said second portion, wherein said latch assembly further comprises third and fourth ribs at spaced separation and with said third rib closer to a first of said at least two generally flexible ribs and said fourth rib closer to a second of said at least two generally flexible ribs, wherein opposite ends of said first portion of said shaft in said mounted position are positioned proximate said third and fourth ribs, respectively.

12. A latch assembly of claim 11 further comprising fifth and sixth ribs at spaced separation, with said fifth rib positioned between said first of said at least two generally flexible ribs and said third rib and with said sixth rib positioned between said second of said at least two generally flexible ribs and said fourth rib, wherein said first portion of said shaft engages said fifth and sixth ribs during operation.

13. A latch assembly of claim 12, wherein each of said ribs extend outwardly a predetermined amount from said bottom surface of said handle, wherein said third and fourth ribs at least adjacent said connecting member extend further from said surface of said handle than said fifth rib, sixth rib and said at least two generally flexible ribs, and said fifth and sixth ribs at least adjacent said connecting member extend further from said surface of said handle than said at least two generally flexible ribs.

14. A latch assembly of claim 13, wherein said handle includes opposing side walls and a front wall, wherein said connecting wall is attached to said opposing side walls and an aperture extends through said handle located extending through a portion of said front wall and through a portion of said connecting wall into which said second portion of said shaft is received in operation.

15. A latch assembly of claim 14, wherein each of said ribs extend along said longitudinal axis of said handle.

16. A latch assembly of claim 15, wherein each of said ribs comprises a generally planer end surface and an adjacent angled surface opposite said bottom surface of said top wall of said handle.

* * * * *